US006647701B2

(12) United States Patent
Rettich

(10) Patent No.: US 6,647,701 B2
(45) Date of Patent: Nov. 18, 2003

(54) DEVICE FOR PRODUCING WRAPPED PRESS BALES

(76) Inventor: Franz Rettich, Bismarckstrasse 14, D-89281 Altenstadt (DE)

( * ) Notice: Subject to any disclaimer, the term of this patent is extended or adjusted under 35 U.S.C. 154(b) by 0 days.

(21) Appl. No.: 10/181,891

(22) PCT Filed: Dec. 15, 2000

(86) PCT No.: PCT/DE00/04526

§ 371 (c)(1),
(2), (4) Date: Sep. 30, 2002

(87) PCT Pub. No.: WO01/58677

PCT Pub. Date: Aug. 16, 2001

(65) Prior Publication Data

US 2003/0056477 A1 Mar. 27, 2003

(51) Int. Cl.[7] ..... B65B 1/24; B65B 11/04

(52) U.S. Cl. ..... 53/528; 53/529; 53/540; 53/587; 53/588

(58) Field of Search ..... 53/528, 529, 540, 53/587, 588; 100/68, 210

(56) References Cited

U.S. PATENT DOCUMENTS

| | | | | |
|---|---|---|---|---|
| 3,720,052 A | | 3/1973 | Anderson et al. | |
| 3,910,438 A | * | 10/1975 | Anderson et al. | 100/210 |
| 4,524,685 A | | 6/1985 | Bergmann | |
| 4,593,517 A | * | 6/1986 | Mattila | 53/556 |
| 4,607,476 A | * | 8/1986 | Fulton, Jr. | 53/587 |
| 5,168,800 A | * | 12/1992 | Margolis | 100/210 |
| 5,566,530 A | * | 10/1996 | Johnstone et al. | 53/556 |
| 5,596,864 A | | 1/1997 | Reeves | |
| 5,623,808 A | * | 4/1997 | Franklin et al. | 53/588 |
| 6,499,276 B2 | * | 12/2002 | Lacey | 53/529 |

FOREIGN PATENT DOCUMENTS

| | | |
|---|---|---|
| DE | 3 132 202 | 3/1983 |
| FR | 2 660 522 | 10/1991 |
| GB | 1 537 659 | 1/1979 |

* cited by examiner

*Primary Examiner*—John Sipos
(74) *Attorney, Agent, or Firm*—Burns, Doane, Swecker & Mathis, LLP

(57) ABSTRACT

The invention relates to a device for producing wrapped press ales. A material which can be pressed is situated in said bales. The inventive device comprises a press device (18) that is arranged in such a way that said press device can be moved vertically. Said press device is provided with at least one conical compressor roller that can be driven. The inventive device further comprises a receiving device that is designed as an open, cylindrical hollow body and serves for receiving the material to be pressed and a base plate that closes the receiving device toward the bottom, is detachably arranged by means of the receiving device and serves for supporting the press bales. The invention is characterized in that the receiving device and the base plate are rotatably mounted around a mutual vertical axis. In addition, the base plate can be moved in the vertical direction. A wrapping device being provided with at least one wrapping head is arranged in such a way that the at least one wrapping head is located at the height of the mutual connection area of the receiving device and the base plate when the wrapping procedure is started.

15 Claims, 2 Drawing Sheets

DEVICE FOR PRODUCING WRAPPED PRESS BALES

BACKGROUND OF THE INVENTION

The invention relates to a device for producing wrapped pressed bales, in which a material which can be pressed is present, having a pressing device which is arranged so as to be movable vertically and which is provided with at least one rotatable tapered compressor roller, having a receiving device which is constructed in the form of an open cylindrical hollow body for receiving the material to be pressed, and having a base plate—closing the receiving device towards the bottom and arranged so as to be detachable from the receiving device—for supporting the pressed bales.

It is known to press bulk materials or plant materials, or even refuse, into pressed bales and to wrap them with a viscoplastic foil for the purpose of storage and/or transportation.

EP 0 106 268 A1 should be mentioned as the closest prior art. This publication describes a device for compressing packaging material and easily pressable waste in a cylindrical container open at the top. In this device it is provided that a centrally arranged and vertically extending shaft is arranged on an arm of a stand engaging over the container, at least one support, which extends horizontally and on which a compressor roller is rotatably mounted, being provided at the lower end of the said shaft, and the compressor roller resting on the refuse by virtue of its own weight. Because of the rotation of the shaft the compressor roller rolls on a circular path on the refuse to be pressed, in which case the compressor roller and the shaft are moved upwards accordingly as the pressed layer of refuse increases. When the pressing procedure has finished, a pressed bale is formed which has not been wrapped. This means that with this device it is possible to press only those materials or substances which do not fall apart again on account of their structure after the pressing procedure. Refuse is a typical example of this. If, on the other hand, it is desired to press bulk materials or, for example, plant materials chopped into small pieces, limits would be encountered very quickly, since at least partial quantities of the pressed material would become detached from the pressed bales or the latter would even fall apart again during the transportation of pressed bales of this type at the latest.

On the basis of this prior art, the object of the invention is further to develop a device of the type defined in the introduction in such a way that it is suitable for pressing materials of widely different types. In this case it should be possible to set the device to be produced with a view to optimizing the pressing procedure to the materials to be pressed. The device should allow the pressed bales to be wrapped with foil, without the production procedure of the pressed bales being delayed.

SUMMARY OF THE INVENTION

The object is attained in that the receiving device and the base plate are mounted so as to be rotatable about a common vertical axis, the base plate can additionally be moved in the vertical direction, and a winding device provided with at least one winding head is arranged in such a way that at the beginning of the winding procedure the at least one winding head is situated at the level of the common connexion area of the receiving device and the base plate.

The essential advantage of the invention is that the manner of operation of the proposed device can be set to the physical properties of the material to be pressed. This can be achieved in particular on account of the fact that the receiving device, the base plate and the compressor rollers can be rotated independently of one another. As a result, different operating states can be set up with the possibility of devising and applying the optimum pressing procedure for a specific material. In the case of awkwardly shaped materials, such as occur for example in refuse, the receiving device and the base plate will be allowed to rotate more slowly than in the case of chopped-up plant material. In this case, solely because this material can be supplied more uniformly to the receiving device, the receiving device and the base plate can be rotated more rapidly. It is not absolutely necessary, however, for the receiving device and the base plate to be moved in synchronism, but the receiving device can even be at a standstill when it is used to optimize a pressing procedure. Even the rotational movements of the compressor rollers can be selected differently. It has also been found to be advantageous if the pressed bale can be pressed out downwards out of the receiving device, in which case the winding device is activated at the same time and the pressed bale is progressively wrapped with foil by the winding head. It has likewise been found to be advantageous to keep the winding head in readiness at that level at which the wrapping of the pressed bale can begin immediately after the pressing procedure is concluded. As a result, no valuable time is lost during the production process.

The invention allows further advantageous embodiments. In this way it is possible, in addition to the possibilities of variation just mentioned, also to select the pressing forces of the pressing device to be at different degrees. In particular, in the case of delicate material, for example material such as is provided as animal feed, the pressing forces will be kept low. In the same way it is possible to operate at high pressing forces when the material to be pressed, such as refuse, also permits forces of this magnitude. Pressed bales can then in fact be produced which have a very high density and so equal units of volume of material to be pressed require correspondingly less space.

In accordance with a further embodiment of the invention it is recommended to arrange the longitudinal axis of the at least one tapered compressor roller so as to be inclined from the outside to the inside, so that each compressor roller can be moved with its outer end-face boundary to close to the inner wall of the receiving device. In this case it has been found to be useful if, when at least two compressor rollers are used for example, one of the rollers is longer than the other compressor roller and the longer roller extends beyond the vertical axis of the receiving device as viewed from above. In this way, no area remains unpressed in the centre when the base plate is rotating on the pressed bale.

Finally, in accordance with a third embodiment it is likewise advantageous, not only for a sweeping means to be provided on the at least one compressor roller, but likewise for a further sweeping means—which extends in the vertical direction and which is used to sweep the inner wall of the receiving device and thus to keep it clean—to be arranged on the pressing device.

BRIEF DESCRIPTION OF THE DRAWING

The invention is explained in greater detail with reference to an embodiment illustrated graphically and diagrammatically. In the drawing

DESCRIPTION OF A PREFERRED EMBODIMENT OF THE INVENTION

Figure 1:
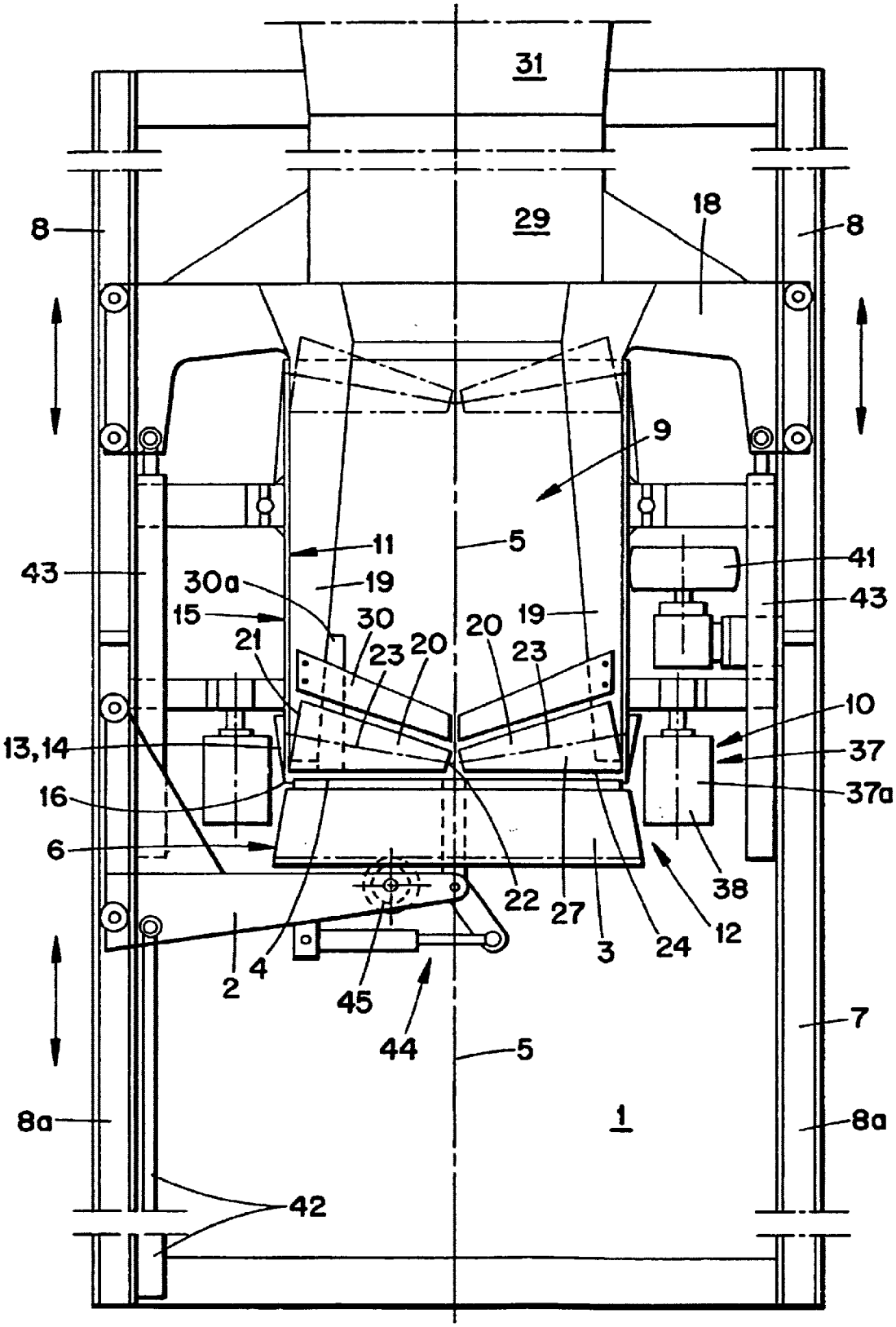
FIG. 1 shows a device at the beginning of the filling and pressing procedure.

The device 1 intended to produce wrapped pressed bales 33 comprises stationary support frame 7. The support fame 7 is provided with lower guides 8*a* which extend vertically and in which a support device 2 is guided so as to be movable vertically. The support device 2 carries a base plate 3 which, driven by a motor 45, can e rotated about a vertical axis 5. A receiving device 9 for receiving material 31 to be pressed, for example bulk material, plane material or even refuse, is situated above the base plate 3. The receiving device 9 is cylindrical. It is arranged on the support frame 7 and mounted so as to be rotatable and, like the base plate 3, can rotate about the vertical axis 5. For this purpose a friction wheel 41, which is driven by a motor and which is pressed against the outer cover 15 of the receiving device 9, is provided for example. The receiving device 9 resembles a tube with a large diameter standing upright. Mutually opposed upper guides 8, in which a pressing device 18 is guided so as to e movable vertically, are arranged on the support frame 7. The pressing device 18 passes with two strong arms 19 from above downwards into the receiving device 9. One respective tapered or conical compressor roller 20, the respective longitudinal axes 23 of which are arranged inclined with respect to a horizontal line, is provided on the lower lend of each arm 19. The compressor rollers 20 are arranged in such a way that the diameter of their end face 21 situated on the outside is greater than the external diameter of their end face 22 situated on the inside. The position of the longitudinal axes 23 of the compressor rollers 20 is selected in such a way that their running faces 24 can rest closely against the horizontal plane 4 of the base plate 3 situated thereunder as is also clearly shown in the drawing. It is additionally clear from the drawing that, as a result of the arrangement—thus selected—of the compressor rollers 20 mounted in an overhung manner in the example, it is possible for the end face 11 of each compressor roller 20 situated on the outside to approach close to the cylindrical inner wall 11 of the receiving device 9. A known drive means 27 is situated in each compressor roller 20, sop that the compressor rollers 20, which can be entirely different in length, can be driven so as to be rotatable about their respective longitudinal axis 23. A sweeping means 30 is arranged stationary on the pressing device 15 above each compressor roller 20, in order to permit a substantially uniform feed of the material 31 to e pressed to the compressor rollers 20. It is possible for a further sweeping means 30*a* to be optionally provided, which is present on the pressing device 18 and is arranged vertically and which is used to scrape off the inner wall 11 of the receiving device 9 and to keep it free of material 31 to be pressed. A feed device 19, by which the material 31 to e pressed is conveyed to the receiving device 9, passes from above to the receiving device 9 and to the pressing device 18. A winding device 37, which is provided with at least one winding button or head 37*a* and which is intended to wrap a pressed bale 33, for example with foil 38, is situated close to the lower region 12 of the receiving device 9 and close to the base plate 3. The winding heads 37*a*, which are each mounted so as to be rotatable about a respective axis, can additionally be mounted on a circular path and can be guided so as likewise to be rotatable about the vertical axis 5. The cylindrically shaped base plate 3 is shaped frustoconically on its periphery and tapers upwards. The lower region 12 of the receiving device 9 is shaped conically in the opposite direction. For this purpose a correspondingly shaped ring 13 is provided at the lower end of the receiving device 9 on the outer cover 15 of the latter. Instead of two compressor rollers 20 it is also possible for only one compressor roller 20 or for morn than two compressor rollers 20 to be provided.

Figure 2:
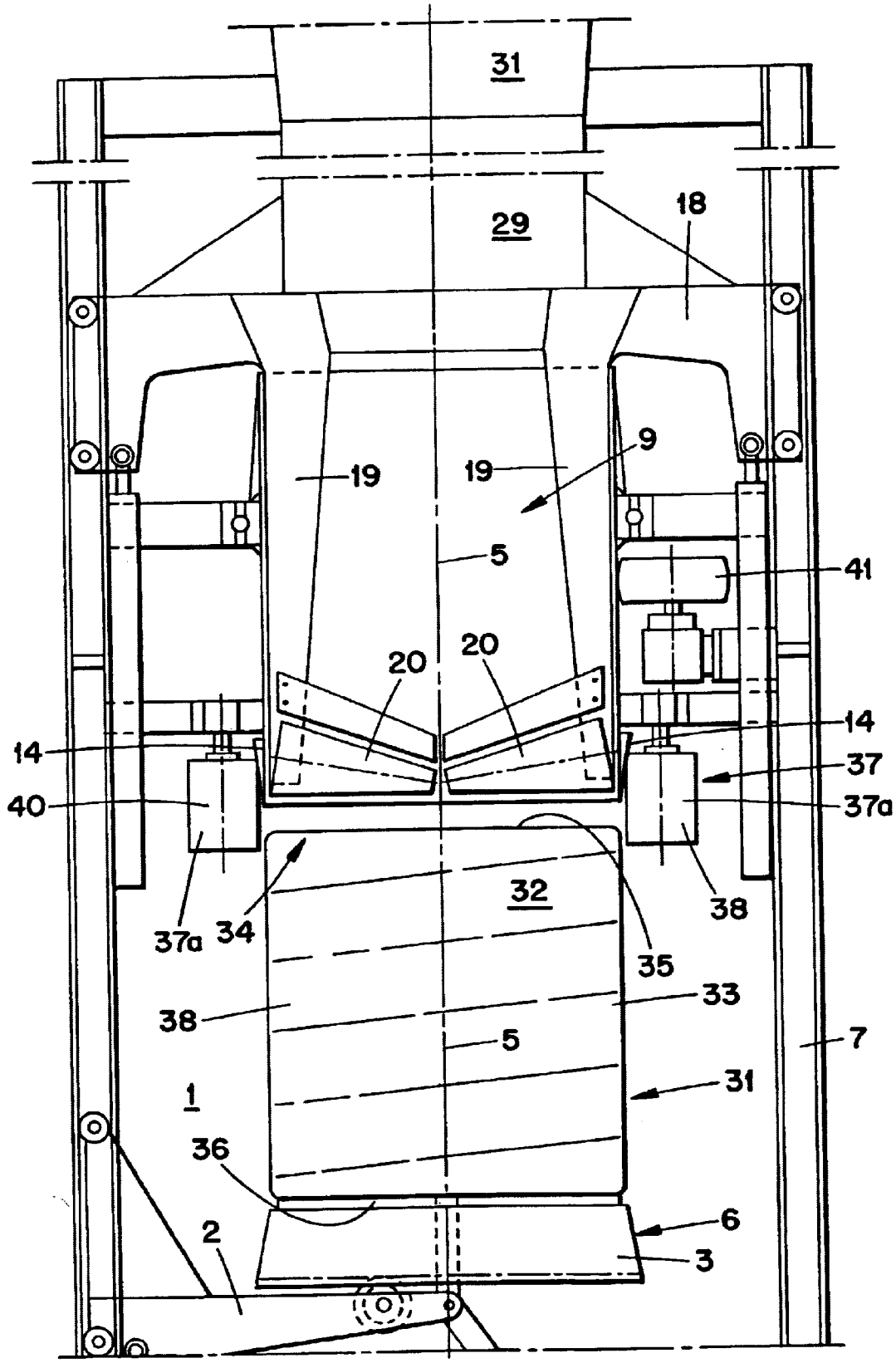
FIG. 2 shows the same device with a pressed bale present on the lowered base plate.

The production of a pressed bale 33 from pressable material 31 may be described as follows:

As shown in FIG. 1, the support device 2 with the base plate 3 has been moved upwards with the aid of at least one hydraulically acting cylinder 42 into the starting position which permits the pressing procedure. The receiving device 9 either rests with the lower edge 16 thereof on the base plate 3, or an annular gap of a few millimeters in height is formed between the base plate 3 and the lower edge 16 of the receiving device 9, so that for example liquid deposited during the pressing procedure can be allowed to run off. The compressor rollers 20 are arranged at a slight distance from the horizontal plane 4 of the base plate 3. Both the receiving device 9 and he base plate 3 are set in preferably synchronous rotary motion with the aid of their drive devices. In the same way, the compressor rollers 20 are made to rotate about their longitudinal axes 23 by their drive means 27. With the aid of the feed device 219 the material 31 to be pressed is now fed from above into the rotating receiving device 9, is gripped by the rotating compressor rollers 20 and is pressed against the likewise rotating base plate 3. The more material 31 to be pressed is added, the more the layer 32 of the now pressed material 31 grows. In this case the pressing device 18 supported at the bottom on cylinders 43 acting hydraulically is actuated as a function of pressure in such a way that the said pressing device 18 likewise moves upwards with the layer 32 growing upwards. The pressure acting upon the layer 32 can be selected to be at different degrees depending upon the nature of the material 31 to be pressed. If refuse is pressed, the pressure will be set considerably higher than for example in the case of pressing plant materials intended for agriculture. A pressed bale 33, which is present in the receiving device 9 and which ca have a different height depending upon the setting, is thus progressively formed. The compressor rollers 20 are indicated in the uppermost end position thereof in dash-dot lines. The distance between the horizontal plane 4 of the base plate 3 and the lower boundary of the compressor rollers 20 determines the height of the pressed bale 33. When the pressing procedure is concluded, the winding device 37 immediately comes into action, in that the at least one winding head 37*a* with the foil 38 present thereon, situated at the level of the common connection area 10 of the receiving device 9 and the base plate 3, rolls both on the conical cover 6 of the base plate 3 and on the conical portion 14 of the receiving device 9. If the base plate 3 is now lowered while the winding device 37 is running and if the pressed bale 33 is accordingly pushed out of the receiving device 9 with the aid of the pressing device 18, the middle region of the pressed bale 33 can also be wrapped. If the lowering is continued and if the pressed bale 33 is pushed completely out of the receiving device 9, vide FIG. 2, the upper region 34 of the pressed bale 33 will also be wrapped, in which case the upper edge region 40 of the foil 38 rolls on the conical portion 14 of the receiving device 9. If the base plate 3 is lowered to the extent that the receiving device 9 is situated at a distance from the pressed bale 33, the upper edge region 40 of the foil 38 is detached from the conical portion 14 and rests closely in an annular manner against the end face 35 of the pressed bale 33 situated at the top. A tilting device 4.4, which is not described in greater detail and by which the support device 2 together with the base plate 3 can be tilted by 90° for example, can e provided on the support device 2, so that the wrapped pressed bale 33 is detached from the base plate 3 and during this procedure the lower edge region 39 of the foil 38 rests closely against the lower end face 36 of the pressed bale 33. The wrapping of the pressed bales 33 with the foil 38 can be accelerated if the at least one winding head 37*a* follows a circular path leading around the vertical axis 5 and the selected direction of rotation is selected to be contrary to the direction of rotation of the base plate 3. If the two end faces 35, 36 of the pressed bale 33 are not quite covered by the foil 38, the pressed bale 33 can be supplied to a further winding device (not shown here). After the pressed bale 33 has been removed, the support device 2 with the base plate 3 is returned again to the starting position and the compressor rollers 20 are moved downwards to close to the base plate 3. A new pressed bale 33 can now e produced again.

What is claimed is:

1. Apparatus for producing a foil-wrapped pressed bale of material, the device comprising:

a receiving device including an open cylindrical hollow body for receiving the material;

a base plate arranged to close a bottom of the hollow body to support the material;

a pressing device including at least one rotatable tapered compressor roller disposed within the hollow body above the base plate;

drive transmitting mechanisms for rotating the receiving device and the base plate simultaneously about a common vertical axis, wherein the material is compressed between the compressor roller and the base plate;

a first force-transmitting mechanism for effecting relative vertical movement between the pressing device and both the hollow body and the base plate during the simultaneous rotation of the receiving device and the base plate, wherein the base plate and the receiving device are separated vertically from one another as the material is being compressed to form a bale of the compressed material within the hollow body and seated on the base plate;

a second force-transmitting mechanism for effecting relative vertical movement between the receiving device and the base plate, wherein the base plate and the receiving device are separated vertically from one another to cause the bale to travel out of the hollow body; and a winding device including at least one winding head carrying wrapping foil and arranged to wind the foil around the bale as the bale travels out of the hollow body, wherein the winding head is situated adjacent a junction between the hollow body and the base plate at initiation of the travel of the bale out of the hollow body.

2. Apparatus according to claim 1 characterized in that the receiving device, the base plate and the at feast one compressor roller are rotatable independently of one another.

3. Apparatus according to claim 1 characterized in that the pressing force of the pressing device is variable.

4. Apparatus according to claim 1 characterized in that the at least one winding head of the winding device is arranged to be stationary or rotatable about the vertical axis.

5. Apparatus according to claim 1 characterized in that the at least one winding head is rotatable about the vertical axis.

6. Apparatus according to claim 1 characterized in that the receiving device can be positioned with its lower edge on the base plate.

7. Apparatus according to claim 1 characterized in that the at least one compressor roller is situated in a lowered starting position of the pressing device at a slight distance from the plane of the base plate.

8. Apparatus according to claim 1 characterized in that the at least one compressor roller is arranged wherein its running face can roll closely on the plane of the base plate.

9. Apparatus according to claim 1 characterized in that the at least one compressor roller is mounted in an overhung manner.

10. Apparatus according to claim 1 characterized in that the at least one compressor roller extends as far as a cylindrical inner wall of the receiving device.

11. Apparatus according to claim 1 characterized in that the at least one compressor roller comprises a plurality of compressor rollers, at least one of the compressor rollers being longer than another of the compressor rollers.

12. Apparatus according to claim 1 characterized in that at least one sweeping means for sweeping an inner wall of the receiving device is provided on the pressing device.

13. Apparatus according to claim 1 characterized in that the base plate is shaped in a frusto-conical manner tapering upwards on its periphery.

14. Apparatus according to claim 1 characterized in that the receiving device is shaped in a frusto-conical manner tapering downwards on the external periphery of its lower region.

15. Apparatus according to claim 1 characterized in that the base plate is arranged so as to be tiltable.

* * * * *

UNITED STATES PATENT AND TRADEMARK OFFICE

CERTIFICATE OF CORRECTION

PATENT NO. : 6,647,701 B2
DATED : November 18, 2003
INVENTOR(S) : Franz Rettich

It is certified that error appears in the above-identified patent and that said Letters Patent is hereby corrected as shown below:

Title page,
Insert item:
-- [30] Foreign Application Priority Data
February 8, 2000 (DE) 100 05 502.8 --

Signed and Sealed this

Twenty-seventh Day of April, 2004

JON W. DUDAS
*Acting Director of the United States Patent and Trademark Office*